US005521890A

United States Patent [19]

Miche et al.

[11] Patent Number: 5,521,890

[45] Date of Patent: May 28, 1996

[54] PUSH-PIECE CROWN FOR A TIMEPIECE

[75] Inventors: Marc-André Miche; Gérard Palix, both of Bienne, Switzerland

[73] Assignee: SMH Management Services AG, Bien, Switzerland

[21] Appl. No.: 326,963

[22] Filed: Oct. 21, 1994

[30] Foreign Application Priority Data

Nov. 25, 1993 [CH] Switzerland ..... 03 531/93

[51] Int. Cl.[6] ..... G04B 29/00

[52] U.S. Cl. ..... 368/319; 368/321

[58] Field of Search ..... 368/281, 282, 368/319, 320, 321, 290

[56] References Cited

U.S. PATENT DOCUMENTS

| | | | |
|---|---|---|---|
| 4,313,187 | 1/1982 | Waki et al. | 368/319 |
| 4,346,464 | 8/1982 | Wenger | 368/289 |
| 4,451,719 | 5/1984 | Lauterburg et al. | 368/321 |
| 5,257,247 | 10/1993 | Miche et al. | 368/290 |

FOREIGN PATENT DOCUMENTS

| | | |
|---|---|---|
| 239783 | 1/1946 | Switzerland . |
| 239240 | 3/1946 | Switzerland . |
| 577701 | 2/1976 | Switzerland . |
| 678138 | 8/1991 | Switzerland . |

*Primary Examiner*—Bernard Roskoski

*Attorney, Agent, or Firm*—Pollock, Vande Sande & Priddy

[57] ABSTRACT

A push-piece-crown (1) mounted on a guide tube (T) secured in a case (C) housing a timepiece, and fixed in rotation as well as axially to a control stem (TR) adapted to occupy at least two axial positions, of which a first ("0") is stable and a second ("–1") is transitory, comprising a head (2) fixed to said stem and mounted to be axially movable on said tube (T), and a return spring (8) bearing at one end on said head (2) for urging it towards said stable position, in which said spring (8) also bears at its other end on an annular abutment (9) movable within said head (2) between said stable position, in which said abutment (9) bears on a shoulder (13) on the interior of said head (2) and said transitory position, in which the abutment (9) rests on a shoulder (E3) of said tube (T).

12 Claims, 4 Drawing Sheets

PUSH-PIECE CROWN FOR A TIMEPIECE

FIELD OF THE INVENTION

The present invention concerns a push-piece-crown suitable for a timepiece and, in particular, for watches of high reliability.

The push-piece-crown can assume three different positions:

- the rest position (position "0") in which the watch operates normally,
- the drawn-out position (position "1") in which the time setting of the watch can be adjusted with the push-piece-crown which is fixedly coupled to the stem, and
- the pushed-in position (position "–1") in which the push-piece-crown briefly closes an electrical contact within the watch.

BACKGROUND OF THE INVENTION

The first two positions (positions "0" and "1") correspond to positions which can be assumed by a standard crown.

The third position (position "–1") is known in multimode watches, in general in watches with a first analog display indicating the time and a second display, often digital using liquid crystals, indicating one or several other watch functions such as a second time or wake-up time, etc. Thus, in operating the push-piece-crown, the desired mode can be actuated. Such push-piece-crowns are fixed to the stem of the movement in a manner such that when the axial or radial position of the push-piece-crown is changed, the stein is axially or radially displaced. In effect, in rest position 0, the push-piece-crown is coupled longitudinally in a rigid manner to the stem and can be drawn out or pushed in. In the drawn-out position (position "1"), the push-piece-crown is also rigidly coupled to the stem in order to transmit angular information to the movement as, for example time setting, by means of such stem.

It is understood that it is indispensable that the push-piece-crown and the stem return into the initial position because if they remain blocked in the pushed-in position or if they do not return exactly to the initial position, the watch remains blocked in the mode which has been activated.

A known possibility for bringing about return of the stem and its push-piece-crown into their initial positions consists in placing a return spring in the head of the push-piece-crown.

However, this design is generally known from simple push-piece-crowns, that is to say, push-piece-crowns having only two positions, the first (which corresponds to the position "0") in which the stem is free and a second position (which corresponds to the position "–1") in which the stem is engaged with the movement permitting time setting for example. Such a push-piece-crown is described in the patent document CH 577 701. Here, the push-piece crown is also provided with a spring, which is of interest for compensating an alignment defect between itself and the movement. Such push-piece-crown does not have the third position (position "–1") and is of a relatively simple design.

When it is desired to increase the assurance of water tightness of the push-piece-crown (watch of high reliability), there can be introduced a larger sealing gasket into the push-piece-crown. However, should one introduce such a gasket or if several such packings are introduced into a design as described hereinbefore, friction between the push-piece-crown and the guide tube is greatly increased and thus the risk is increased that the push-piece-crown not return into its inactive position because of such friction.

The present invention has thus as purpose to overcome such defects while furnishing a push-piece-crown which exhibits the water tightness suitable for watches of high reliability.

SUMMARY OF THE INVENTION

This purpose is achieved thanks to a push-piece-crown for a timepiece, intended to be mounted on a guide tube secured in a case housing said timepiece and to be fixed in rotation as well as axially to a control stem also belonging to said timepiece, said stem being capable of occupying at least two axial positions of which a first ("0") is stable and a second ("–1") is transitory, said push-piece-crown comprising

- a head intended to be fixed to said stem and mounted to be axially movable on said tube so as to be capable of being axially positioned in at least two distinct positions corresponding to said positions of the stem for controlling at least one function of said timepiece, and
- a return spring bearing at one end on said head order to urge it towards said stable position, said push-piece-crown being characterized in that

- said spring also bears at its other end on an annular abutment movable within said head between a first position, which corresponds to said stable position, in which said abutment is supported on a shoulder arranged in the interior of said head and a second position corresponding to said transitory position, in which the abutment rests on a shoulder arranged on said tube.

Thanks to these characteristics of the invention, the spring, in its stable position, is subjected to a strong pre-compression of a nature such that after having been brought from its stable position towards its transitory position, it returns completely into its stable position as soon as it is released, even if the friction between the tube and the crown due to the sealing gasket is high.

As is well understood, the use of a return spring strongly pre-compressed in order to assure its return to the initial position also is suitable for push-pieces in general, for example those the operation of which closes an electrical contact.

The invention also concerns a timepiece characterized in that it comprises a push-piece-crown such as defined hereinabove.

There will be described hereinafter by way of example an embodiment of the object of the invention in having reference to the attached drawings.

DESCRIPTION OF THE PREFERRED EMBODIMENT

Figure 1:
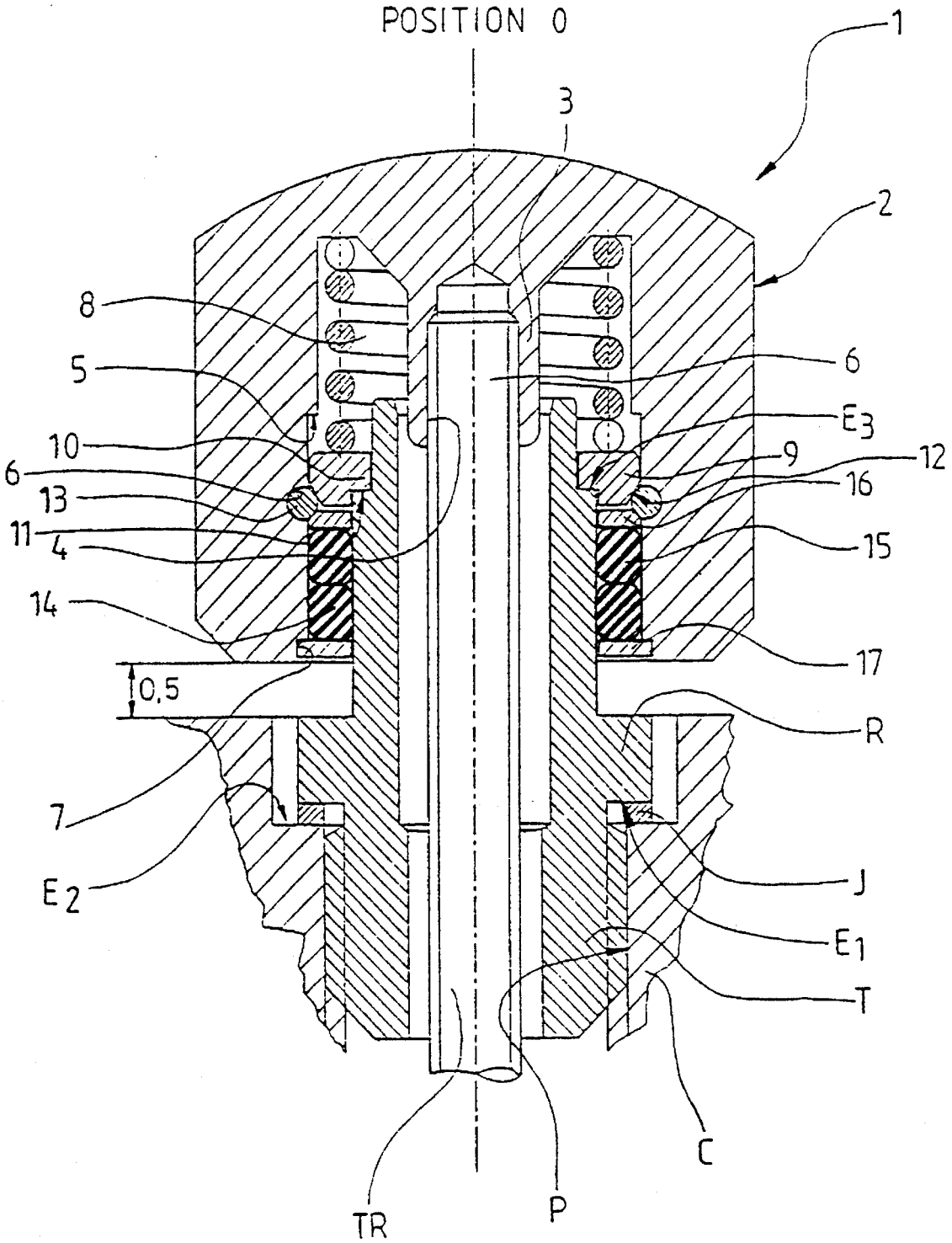
FIG. 1 shows the push-piece-crown according to the invention in the rest position (position "0")

Reference will be had initially to FIG. 1 which shows an embodiment of the push-piece-crown according to the invention, in its rest position, referred to as position "0".

In this example, the push-piece-crown 1 is mounted on a caseband C of a watch, preferably a top range watch, in the lateral edge of which caseband C is screwed a mounting tube T. This latter exhibits an annular flange R defining a radial shoulder E1 coming to bear on a complementary shoulder E2 arranged at the outlet of a radial passage P pierced in the edge of the caseband C. A seal J preferably of silver is interposed between the shoulders E1 and E2. Tube T further includes, close to its free end, another radial shoulder E3 the purpose of which will appear hereinafter.

Tube T serves in the usual manner for the passage of a winding stem TR which can here occupy three positions defined by the movement (not shown) of the watch to which the caseband C belongs.

The three positions of the stem are a neutral or "0" position (FIG. 1), a drawn-out position referred to as "+1" (FIG. 2) in which it enables time setting of the watch and a transitory pushed in position referred to as "−1" (FIG. 3) in which it enables controlling one or several other watch functions, for example by closing of an electrical contact (not shown) provided within the movement.

The stem also includes the usual threading at its free end in order to enable a rigid fixation of a push-piece-crown thereto.

It is to be noted that the arrangement which has just been described is well known and does not form part of the invention. It is also to be noted that in order that the invention find its full application it is not necessary that the stem TR be capable of occupying the drawn-out position, the interest of the invention residing in a better return of the stem and the push-piece-crown from the pushed-in position "−1" towards the neutral position "0".

This being the case, according to the invention, the push-piece-crown 1 comprises a hollow head 2, the bottom of which exhibits a projection 3 provided with a blind hole 4. This latter is threaded on the interior in order to permit screwing of the crown onto the end of the stem TR. In this example, it is seen that at almost the axial mid-length, the interior wall of the head 2 includes a radial shoulder 5. Further on, towards the open end of head 2, such internal wall exhibits an annular groove 6 with a rounded bottom. Finally, close to its exit opening, head 2 further includes an annular groove 7 which here is of rectangular profile.

A return spring 8 of helicoidal form is axially arranged within the hollow head 2 and surrounds the projection 3. This spring bears at its inner end onto the bottom of head 2 while its opposite end is supported on an abutment ring 9 which surrounds the outer end of tube T beyond the shoulder E3. Such ring 9 includes an internal collar 10 defining a radial shoulder 11 intended to come into contact with shoulder E3 of tube T under the action of spring 8, at least in the configuration of the push-piece-crown 1 shown on FIG. 1.

Exteriorly, the abutment ring 9 exhibits a bevelled angular face 12 which is intended to come to bear against a circlips 13 placed in the annular groove 6 of head 2. Ring 9 bears against the circlips 13 in positions "0" and "+1" of the push-piece-crown 1.

The push-piece-crown according to the invention further includes a sealing gasket formed from two rings 14 and 15 of rectangular cross-section and confined, on the one hand, between a washer 16 coming to bear against the circlips 13 and, on the other hand, a washer 17 which is in fact a circlips engaged in groove 7 of head 2.

Figure 2:
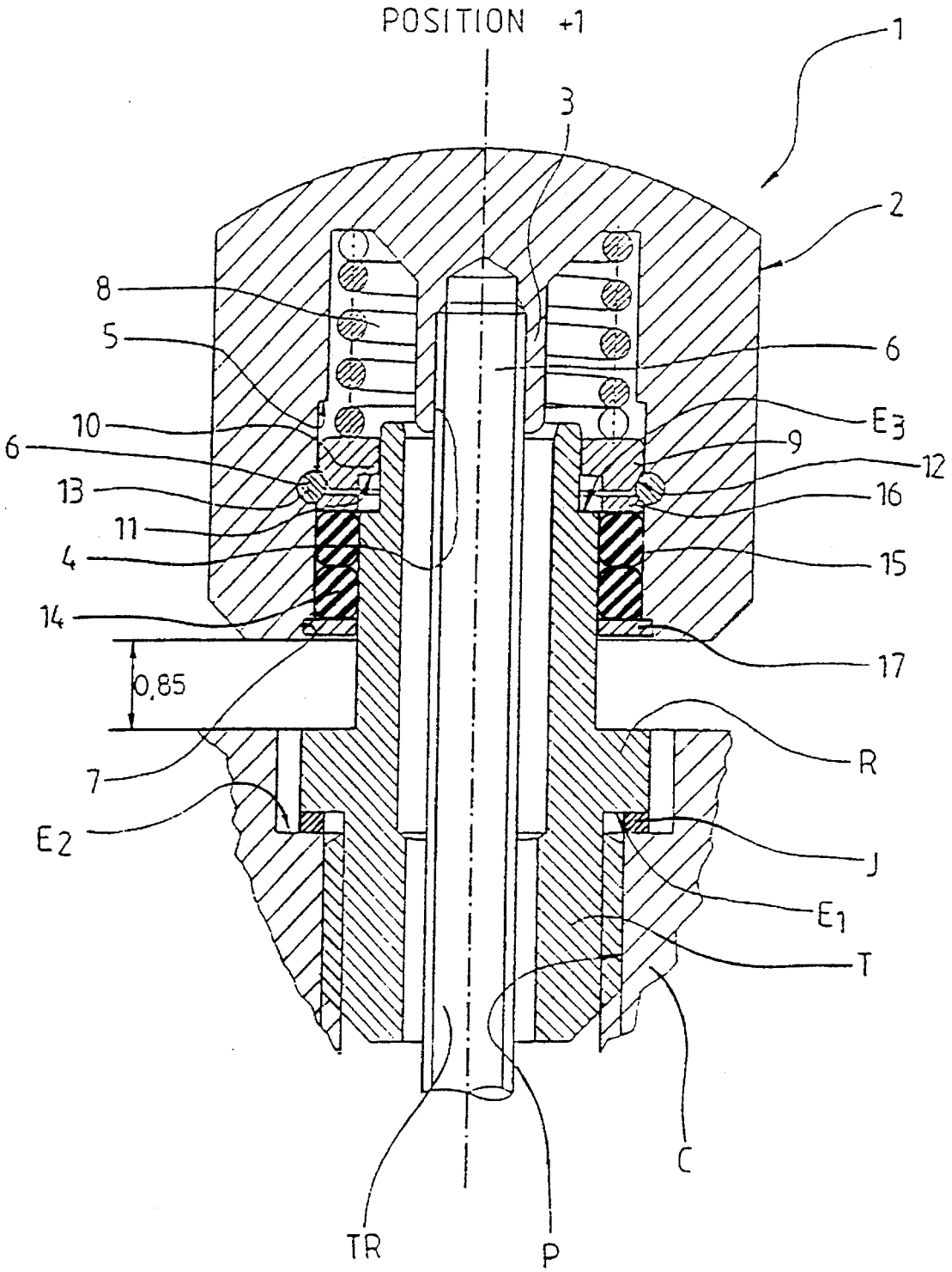
FIG. 2 shows the push-piece-crown according to the invention in the drawn-out position (position "+1")

It is to be noted that in the configurations of the push-piece-crown shown on FIGS. 1 and 2, spring 8 is in a state of pre-compression in being confined between the bottom of head 2 and shoulder 11. Thus, it generates an axial thrust incapable of overcoming the forces which maintain stem TR in its neutral position, which forces are, in a known manner, imposed on such stem by the time setting mechanism (not shown) of the watch movement fitted out with the push-piece-crown according to the invention. As is well understood, this is also true for the drawn-out position "+1" of the stem TR, retained in general within the movement by an axial abutment preventing stem TR from separating from the novement. The pre-compression can be equal, for example, to 60% of the total thrust force of spring 8 when all its coils are squeezed against one another.

There will now be described the operation of the push-piece-crown 1 according to the invention in examining successively FIGS. 1, 2 and 3 with the help of the explanatory graph of FIG. 4.

There has already been indicated hereinabove that the push-piece-crown according to the invention is intended more specifically for assuring an irreproachable return movement of stem TR starting from its transitory position "−1" towards its neutral position "0" and this in spite of the friction forces which can be exerted on such stem by the sealing gasket which surrounds it.

It will be noted that in the example described here, the push-piece-crown 1 can be displaced on either side of its zero position over a distance which is preferably the same. In other words, its axial travel is the same around such position "0". On the figures such travel is by way of example 0.35 mm, the distance separating the face of head 2 opposite the caseband and the lateral face of the latter being respectively 0.50 mm, 0.85 mm and 0.15 mm according to whether the push-piece-crown is in its positions "0", "+1" and "−1". As is well understood, such dimensions depend basically from the design of the movement with which the push-piece-crown is associated and they can thus vary from one type of movement to another.

In the position "0" of FIG. 1, spring 8 is under precompression and tends thus to separate the bottom of head 2 from the face of the abutment ring 9 against which it bears. From this fact the abutment ring 9 is supported not only against circlips 13, but also against shoulder E3 of tube T. Thus, this position "0" is perfectly stable.

If now the user displaces the assembly of stem T3 and push-piece-crown 1 towards the exterior in order to be able to effect a time setting operation of the watch for example, he draws on the push-piece-crown 1 which causes the assembly to be axially displaced through a same translation relative to caseband C (passage from positon "0" of FIG. 1 towards position "+1" of FIG. 2). From this fact, nothing changes for the spring 8 which remains taught between its abutments with the same pre-compression. On the other hand, it will be noted that the ring of abutment 9 is raised from its shoulder E3 of tube T. It is thus seen that the stem TR has been axially displaced relative to the caseband C. It is to be noted that during such displacement the sealing gasket formed from rings 14 and 15 is displaced relative to tube T, but such displacement does not generate any difficulty for good operation since the friction forces are here overcome by the user of the watch.

Figure 4:
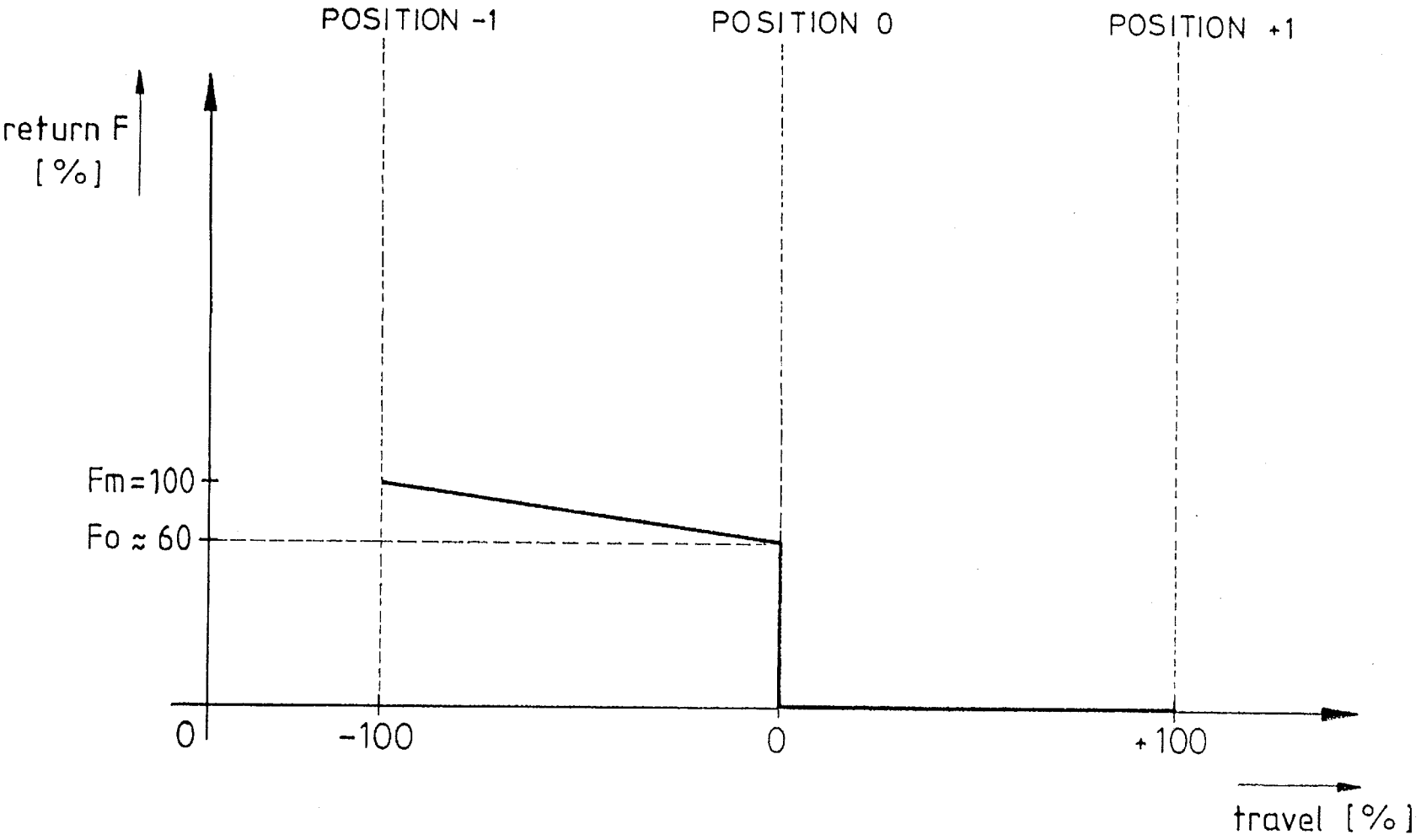
FIG. 4 shows schematically the forces exerted by the return spring on the push-piece-crown according to the invention as a function of the position of such latter.

Consequently, the return force due to spring 8 remains zero and it does not change between the two positions which have just been examined (right-hand portion of the graph of FIG. 4).

Figure 3:
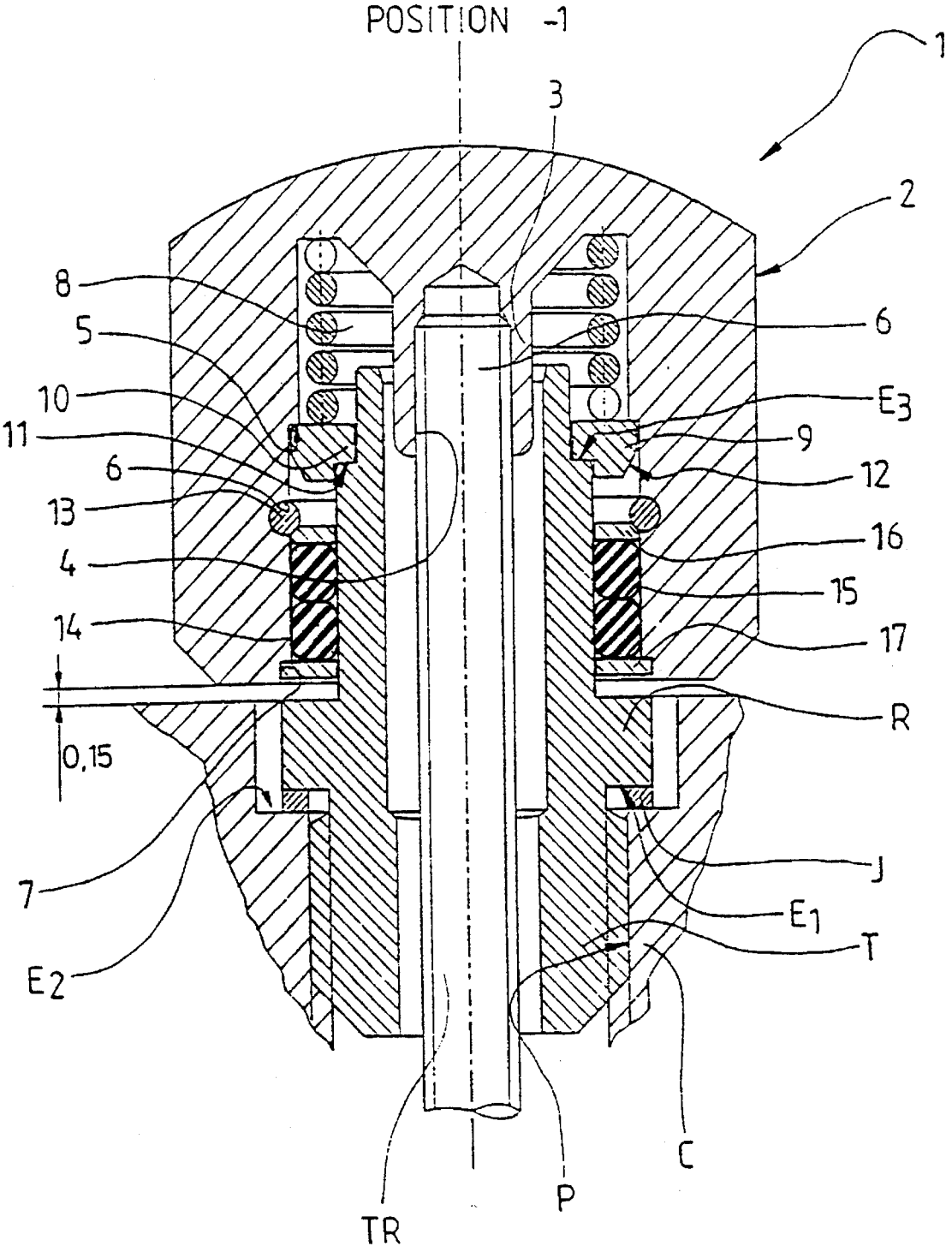
FIG. 3 shows the push-piece-crown according invention in the pushed-in position (position "–1")

It is quite another matter when passage is effected from the neutral position "0" of FIG. 1 to the transitory position "–1" of FIG. 3. In this case, in effect, the abutment ring 9 is axially retained by shoulder E3 of tube T in a manner such that as soon as head 2 is axially displaced towards caseband C, spring 8 will be further compressed than it has been in its state of pre-compression. However, the resistance force of the spring or in other words its return force is then from the beginning equal to the value of the pre-compression force $F_o$, that is to say, as soon as the circlips 13 is detached from the abutment ring 9. In following the travel, such return force can only increase according to the spring constant.

It is thus seen that there is a brusque transition in the development of the return force at the beginning of the pushing-in travel of the push-piece-crown (left-hand portion of the graph of FIG. 4). This brusque increase, far from being bothersome for the user (for it concerns in any case relatively weak forces), is on the other hand very useful for bringing back the push-piece-crown 1 and stem TR to the neutral position of FIG. 1.

In effect, during the pushing-in, it is seen that the rings 14 and 15, strongly urged against tube T in order to guarantee good sealing, slide on tube T. But since spring 8 returns the assembly with a force which is made up of the pre-compression force to which is added the dynamic deformation force of the spring, the return towards the neutral position does not pose any problem, the friction of the rings on tube T being readily overcome.

In the embodiment described, the pushing-in travel towards the transitory position "–1" is limited by the shoulder 5 of head 2. When, as shown, shoulder 5 comes into contact with abutment ring 9, spring 8 is compressed in a manner to furnish a return force which is very close to its maximum compression force ($F_{max}$ on FIG. 4). It is possible, according to a variant, not shown, on the figures, to omit shoulder 5 by means of which the end of the pushing-in travel will be defined by the total compression of spring 8, all its coils being then bearing against one another.

In an advantageous manner, the pre-compression force $F_o$ can be chosen as a function of the needs. For example, in the case of user of a push-piece-crown according to the invention, in diver's watches, it is important that the pressure of the water not push in the push-piece-crown. One must then choose such pre-compression as a function of the depth which can be attained with the watch. It is thus understood that it is necessary to push the push-piece-crown relatively strongly in order to attain the position "–1" for watertight watches at a very great depth. In such a case, the pre-compression $F_o$ can be equal to more than 70% of the maximum compression force $F_{max}$.

We claim:

1. A push-piece-crown in combination with a guide tube for a timepiece having a control stem axially movable between at least two axial positions of which one is stable and the other is transitory for controlling at least one function of said timepiece, said guide tube comprising a shoulder and being arranged to be secured in a case housing a movement of said timepiece, and said push-piece-crown comprising:

a head arrange to be fixed in rotation as well as axially to said control stem, said head being mounted for axial movement on said guide tube so that it may occupy at least a stable position and a transitory position, and said at least two head positions being axially distinct positions corresponding to said two axial positions of the control stem; and, a return spring having one end bearing on said head in order to urge it towards said stable head position, and another end bearing on an annular abutment movable within said head between a first position corresponding to said stable head position, in which said annular abutment is supported on a support shoulder in the interior of said head for causing a precompression of said return string, and a second position corresponding to said transitory head position, in which said annular abutment engages said shoulder on said guide to cause further compression of said return spring.

2. A push-piece-crown as set forth in claim 1, wherein said support shoulder in the interior of said head is formed by a support element arranged within said head.

3. A push-piece-crown as set forth in claim 2, wherein said support shoulder forming element is a "circlips" located in an annular internal groove of said head.

4. A push-piece-crown as set forth in claim 2, wherein the precompression of said return spring is at least about 60% of its maximum compression when all of the its coils are squeezed against one another.

5. A push-piece-crown as set forth in claim 1, further comprising a sealing gasket arranged to be located between said head and said guide tube for isolating from the exterior an internal portion of said push-piece-crown, said return spring and the timepiece movement.

6. A push-piece-crown as set forth in claim 5, wherein said sealing gasket is maintained within said head by a pair of washers, one of which is axially supported against said support shoulder forming element and the other of which is engaged in an annular groove formed in the interior of said head.

7. A timepiece including a push-piece-crown mounted on a guide tube secured in a case housing a movement of said timepiece and fixed in rotation as well as axially to a control stem also belonging to said timepiece, said control stem being axially movable between at least two axial positions of which one is stable and the other is transitory for controlling at least one function of said timepiece, and said push-piece-crown comprising:

a head fixed to said control stem and mounted for axial movement on said guide tube so that it may occupy at least a stable position and a transitory position, said at least two head positions being axially distinct positions corresponding to said two axial positions of the control stem, and a return spring having one end bearing on said head in order to urge it towards said stable head position, and another end bearing on an annular abutment movable within said head between a first position corresponding to said stable head position, in which said annular abutment is supported on a support shoulder in the interior of said head for causing a precompression of said return spring, and a second position corresponding to said transitory head position, in which said annular abutment engages a shoulder on said guide tube to cause further compression of said return spring.

8. A timepiece including a push-piece-crown as set forth in claim 7, wherein said support shoulder in the interior of said head is formed by a support element arranged within said head.

9. A timepiece including a push-piece-crown as set forth in claim 8, wherein said support shoulder forming element is a "circlips" located in an annular internal groove of said head.

10. A timepiece including a push-piece-crown as set forth in claim 8, wherein the precompression of said return spring is at least about 60% of its maximum compression when all of its coils are squeezed against one another.

11. A timepiece including a push-piece-crown as set forth in claim 7, further comprising a sealing gasket located between said head and said guide tube for isolating from the exterior an internal portion of said push-piece-crown, said return spring and the timepiece movement.

12. A timepiece including a push-piece-crown as set forth in claim 11, wherein said sealing gasket is maintained within said head by a pair of washers, one of which is axially supported against said support shoulder forming element and the other of which is engaged in an annular groove formed in the interior of said head.

* * * * *